US006311647B1

(12) United States Patent
Liebig et al.

(10) Patent No.: US 6,311,647 B1
(45) Date of Patent: Nov. 6, 2001

(54) METHOD AND DEVICE FOR CONTROLLING THE TEMPERATURE AT THE OUTLET OF A STEAM SUPERHEATER

(75) Inventors: Erhard Liebig, Laufenburg (DE); Rudolf Herzog, deceased, late of Tobel, Theresa Herzog, administrator; Hamid Olia, Wallisellen, both of (CH); Wolf-Stephan Wilke, Constance (DE); Georg Ziegler, Winterthur (CH)

(73) Assignee: Alstom (Switzerland) Ltd, Baden (CH)

( * ) Notice: Subject to any disclaimer, the term of this patent is extended or adjusted under 35 U.S.C. 154(b) by 0 days.

(21) Appl. No.: 09/484,179

(22) Filed: Jan. 18, 2000

(30) Foreign Application Priority Data

Jan. 18, 1999 (DE) ..... 199 01 656

(51) Int. Cl.[7] ..... F22G 5/12

(52) U.S. Cl. ..... 122/479.1; 122/487; 122/438; 122/451.1; 122/466

(58) Field of Search ..... 122/1 B, 1 C, 122/438, 444, 448.4, 451.1, 451 S, 460, 466, 467, 468, 487, 479.1, 479.7

(56) References Cited

U.S. PATENT DOCUMENTS 3,942,483 * 3/1976 Laubli ..... 122/451 S
4,241,701 * 12/1980 Morse ..... 122/460
4,969,084 * 11/1990 Smith ..... 122/479.1
5,307,766 * 5/1994 Pearce ..... 122/479.1
5,605,118 * 2/1997 Sinn et al. ..... 122/479.1
5,924,389 * 7/1999 Palkes et al. ..... 122/451 S

FOREIGN PATENT DOCUMENTS 215 439 11/1960 (AT) .
702 231 1/1941 (DE) .
852 092 8/1952 (DE) .
877 311 4/1953 (DE) .
975 895 10/1962 (DE) .
41 17 796 1/1993 (DE) .
38 41 741 2/1993 (DE) .
0 263 056 4/1988 (EP) .

* cited by examiner

*Primary Examiner*—Gregory Wilson
(74) *Attorney, Agent, or Firm*—Burns, Doane, Swecker & Mathis, L.L.P.

(57) ABSTRACT

After the economizer, an injection water pipe branches off the connecting pipe between economizer and evaporator in order to control the steam temperature. The injection water pipe is provided with a control device for controlling the injection water flow. The injection water flowing through the injection water pipe is injected into the steam coming from the evaporator at a mixing point located before the superheater. In order to control the position of the control device in the injection water pipe, the enthalpy at the superheater outlet is calculated from the parameters pressure and temperature and is compared with a desired enthalpy resulting from the desired parameters.

9 Claims, 3 Drawing Sheets

METHOD AND DEVICE FOR CONTROLLING THE TEMPERATURE AT THE OUTLET OF A STEAM SUPERHEATER

FIELD OF THE INVENTION

This invention relates to steam boiler systems, and more specifically, to methods and devices for controlling the temperature at the outlet of a steam superheater.

BACKGROUND OF THE INVENTION

In most steam boilers, the steam temperature is controlled at the boiler outlet by injecting water in the mostly subcooled state at one or more points in the superheater train. This water is usually removed before the economizer and evaporates after the injection point, so that the enthalpy and therefore the temperature of the superheated steam is lowered at the injection or mixing point of the respective heating surfaces. This also reduces the temperature at the outlet of the respective heater surface.

In known methods, the temperature reduction is limited by the water injection, and only such an amount of water can be injected that the steam remains sufficiently superheated after the mixing of the injection water and steam. The purpose is the prevention of temperature shocks that may be created by impermissibly large temperature drops, or caused by the impact of cold injection water droplets on the hot, steam-carrying pipes.

Known injection control loops are constructed in a cascading manner, whereby the subcontrol loop controls the inlet temperature before the respective superheater. The information of the inlet temperature is lost, however, as soon as a two-phase mixture at saturation temperature is present after mixing. The controlling then would have to be performed manually.

As a result, the possible drop in temperature through the injection of water in the designs known so far is critically limited, since it is not possible to inject an amount of water that would lower the steam temperature to the saturated steam temperature.

The known injection coolers furthermore have a very high constructive expenditure; each injection cooler between the heating surfaces shares the heating surface bundles and requires corresponding headers and connecting pipes.

In respect to energy, the past practice of injecting water between or after the superheater heating surfaces has the disadvantage that the steam temperature control on the one hand is coupled with a drop of the already achieved high steam temperature with, on the other hand, a water evaporation at a low temperature level. The result is an adverse effect on the efficiency of the superheater or boiler. Another disadvantage is, in respect to materials, the heating surface design for higher temperatures.

Of special significance is the problem of steam temperature control, e.g., in refuse incineration plants, i.e., in plants with increasing fouling of the heating surfaces in the combustion chamber. This results in a steady increase of the flue gas temperature before the superheater. In order to be able to maintain the steam temperature after the superheater, the injection water quantity must be increased. This often requires installation of several intermediate injection coolers.

SUMMARY OF THE INVENTION

It is an object of this invention to overcome the disadvantages described above. The invention is based on the objective of creating a method of the initially described type in which a respective superheater train without injection cooler can be constructed between the heating surface segments and/or at the end of the heating surfaces. Superheater and reheater should be integrated with the possibility of an at least partial operation as evaporators in the start-up process of, for example, a steam power plant.

A frontal part of the medium flowing through the superheater according to the invention works as an evaporator at a saturation temperature with a high internal heat transfer so that the metal temperature and also the degree of corrosion can be kept low. The flue gas temperature is also reduced in the area of the superheater outlet, thus increasing the efficiency of the boiler. The economizer is relieved. No intermediate headers and additional injection coolers are necessary in the superheater train.

According to the invention, this is achieved in that the injection water $\dot{m}_D$ $m_{EW}$ is injected into the steam at the inlet of the superheater. If the superheater is constructed of several heating surface bundles, the inlet into the superheater is in this case the inlet into the overall superheater train. A suitable temperature control is used to control the superheater outlet temperature. For this purpose, the steam parameters pressure PIST,A and temperature $t_{IST,A}$ are measured at the superheater outlet. From these parameters, the enthalpy of the steam $h_{IST,A}$ is determined and is compared with a desired enthalpy $h_{S,A}$ resulting from the desired value of the steam temperature $t_{S,A}$ the present pressure $_{PIST,A}$. In addition to this, the steam mass flux $\dot{m}_D$ $m_D$ is determined at a suitable point. This means that an energy and mass balance at the mixing point can be used to calculate the inlet enthalpy $h_E$ into the superheater and can be sent to the enthalpy control in order to improve the control quality.

In a preferred embodiment, water is injected at the inlet into the superheater in such quantities that saturated steam conditions exist at the outlet of the superheater. In this case the entire superheater is operated as an evaporator. In another case, such a quantity of water is injected that wet steam conditions exist at the outlet of the superheater. The residual moisture is then separated by a separator.

In a device according to the invention for performing the method that comprises a steam generator including a superheater with superheater tubes and an inlet header, a mixing point for mixing in the injection water is arranged in the area of the inlet header of the superheater.

A steam superheater for performing the method is characterized by an injection water pipe comprising a control device, with said injection water pipe extending to the inlet area of the superheater.

A steam boiler for performing the method, where said steam boiler comprises an evaporator, a superheater, and a conduit extending from the evaporator to the superheater, is characterized by an injection water pipe comprising a control device that extends to the inlet area of the superheater.

A control for performing the method, which is used to control the position of the control device in the injection water pipe is characterized in that the enthalpy at the superheater outlet ($h_{IST,A}$) is calculated from the parameters pressure ($p_{IST,A}$) and temperature ($t_{IST,A}$) at the superheater outlet and is compared with a desired enthalpy $h_{S,A}$ resulting from the desired temperature $t_{S,A}$ by the present pressure $p_{IST,A}$.

A further embodiment of the control for improving the control quality calculates the inlet enthalpy ($h_E$) into the superheater from the energy and mass balance at the mixing point and send it to the enthalpy control.

According to an especially preferred embodiment, a separator is arranged at the outlet of the superheater. If the steam at the outlet of the superheater contains residual moisture, this residual moisture can be removed by the separator, and saturated steam can be provided. The separator can be used to advantageously protect the pipes and steam turbine from erosion.

The concept of the invention will be described using the example of the superheater of a random boiler, but shall apply to all heating surfaces functioning in the superheated area, in particularly also to the reheater.

BRIEF DESCRIPTION OF THE DRAWINGS

The following explains the subject of the invention in more detail in reference to the accompanying drawings showing several embodiments of the invention in which.

DETAILED DESCRIPTION

Figure 1:
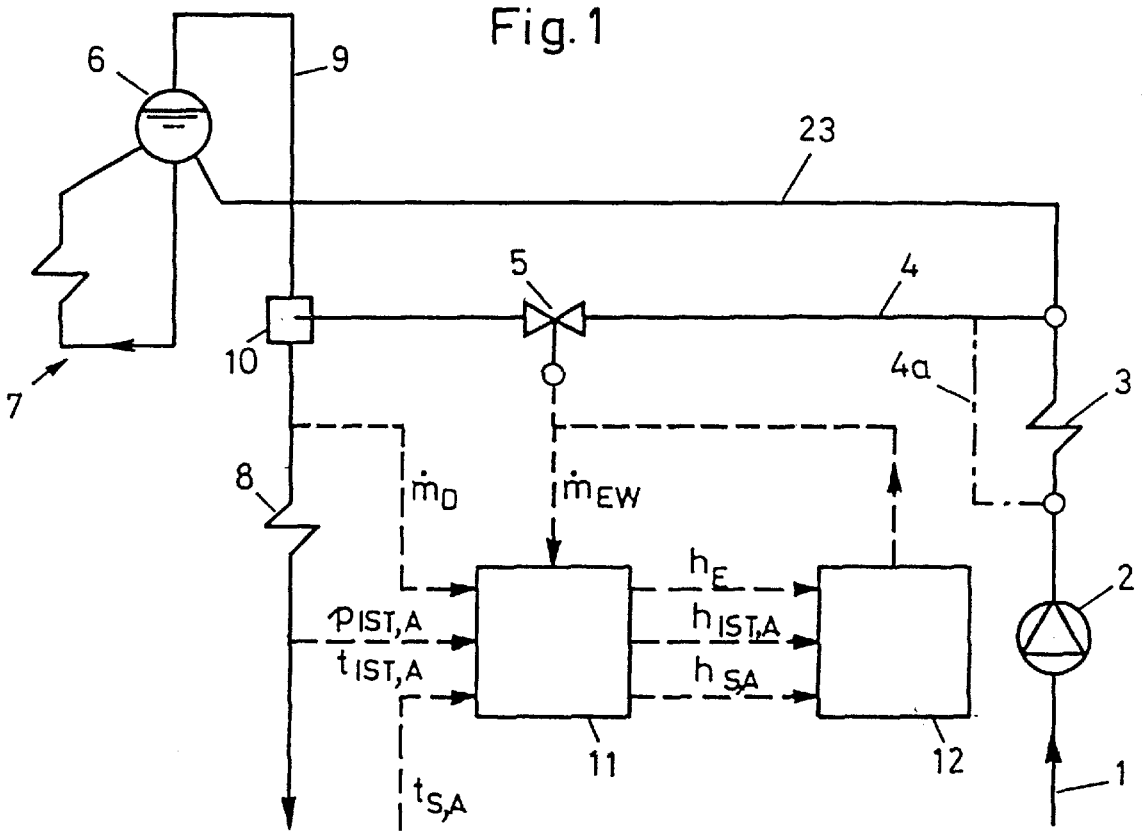
FIG. 1 schematically shows a conventionally fired drum boiler for explaining the method according to the invention.

FIG. 1 is solely a schematic portrayal of a conventionally fired drum boiler for explaining the method according to the invention. As will be shown below, the method can be performed just as well with a once-through boiler. It should also be noted that all steam boilers shown in the drawings have only a single pressure stage. The method according to the invention also can be used with boilers having several pressure stages, for example, heat recovery steam generators.

In general, it should be noted that the method according to the invention is valid independently from the principle of steam generation and independently from the construction and design of the boiler.

Feed water flows through the feed water pipe 1 and is pumped by a feed water pump unit 2 to an economizer 3. An injection water pipe 4 branches off at the economizer outlet. According to another embodiment, the injection water pipe also may branch off the feed water pipe 1 before the economizer 3, as is shown in FIG. 1 with the slash-dotted line 4*a*. The site of the branch-off of the injection water line 4 depends on the respective pressure drop that exists between the branch-off point and the injection point in the steam boiler that will be described below. In the case of a sufficient pressure drop, the injection water pipe 4 is advantageously branched off after the economizer 3 from the connecting pipe 23, between the economizer 3 and the evaporator drum 6, since the feed water temperature at this point is close to the saturation temperature, so that temperature shocks are prevented and more favorable conditions for mixing injection water and steam are ensured.

The injection water pipe 4 furthermore has an integrated control device 5, for example, a control valve.

The connecting pipe 23 extends in the known manner after the economizer 3 into the drum 6 of the evaporator 7. From the drum 6, i.e., its steam chamber, the steam pipe 9 runs to the superheater 8.

According to the drawing in FIG. 1, the injection water pipe 4 ends at a mixing point at the inlet of the superheater 8 into the steam flow. In this context, it must be noted that the drawn site of the mixing point 10 is used only to explain the method according to the invention. As will be shown below, this mixing point, in respect to construction, is located in the area of the inlet header of the superheater 8.

According to the invention, the injection water is mixed with the steam prior to the superheating; in this embodiment to the saturated steam after the drum 6, which produces wet steam, i.e., a two-phase mixture so that the first part of the superheater 8 functions as an evaporator. This clearly extends the possible cooling action of the injection cooler 10.

The control of the live steam temperature is now accomplished as a rule by regulating the position of the control device 5. This uses a control which in FIG. 1 is divided into a first part of control (calculator) 11 and a second part (controller) 12 in order to explain the invention. The first part of control (calculator) 11 of the control receives the parameters of the steam after the superheater 8. From these parameters, the enthalpy of the steam at the superheater outlet is calculated in the first part of control (calculator) 11. The calculated value is fed to the second part of control (controller) 12 of the control in which a comparison with the desired value takes place. If the calculated value deviates from the desired value, the second part of control (controller) 12 of the control changes the position of the control device 5, and therefore the quantity of injected water, in such a way that the desired value is again achieved. This regulates the outlet enthalpy after the superheater 8, and thus the outlet temperature of the steam.

In order to increase the control quality, a further step provides that the first part of control (calculator) 11 of the control determines from the parameters at the mixing point, by means of an energy and mass balance, the enthalpy at the inlet into the superheater, and this value is then sent to the enthalpy control.

By injecting water in the area of the mixing point 10, it is possible, as already mentioned, to control the steam condition at the outlet of the superheater. The control range is hereby identical to the superheater range. In a preferred application, saturated steam is supposed to be made available at the outlet of the superheater. As a rule, the output steam may deviate from the desired saturated steam conditions in two ways. First, a too strong heating of the steam by the superheater or an insufficient water injection results in superheated steam (also called hot steam). Second, the injection of too much water into the superheater results in the output of wet steam.

If superheated steam is present at the superheater outlet, the quantity of injected water is increased by slightly opening the control device 5, and the temperature of the superheated steam is reduced until the superheater outputs saturated steam at its outlet. If wet steam is present at the superheater outlet, a slight closing of the control device reduces the quantity of injected water until the superheater outputs saturated steam at its outlet.

Figure 2:
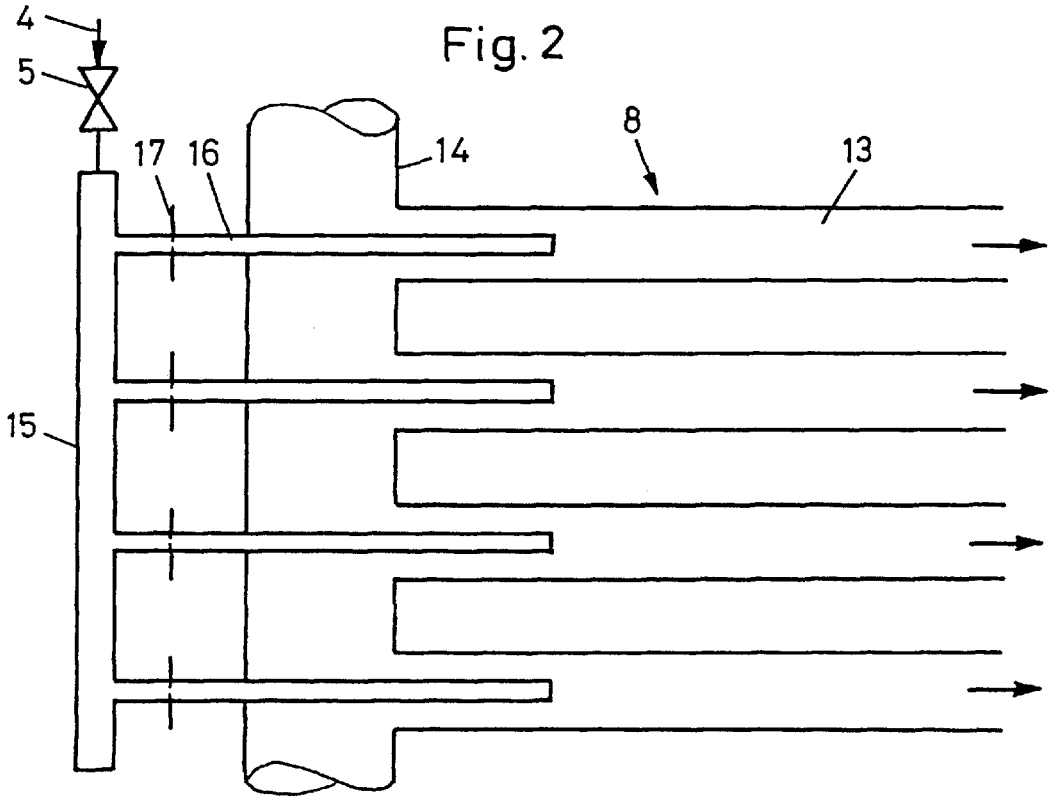
FIG. 2 shows a simplified illustration of the inlet header of a superheater or reheater with an arrangement for injecting water.

FIG. 2 shows a simplified illustration of the inlet header 14 of a superheater 8 to which the injection water is added.

In FIG. 2, the superheater tubes designated with the reference number 13 originate from an inlet header 14. The injection water pipe 4 ends in an injection water manifold 15. This injection water manifold 15 is located parallel to the inlet header 14. Injection water lances 16 originate from the injection water manifold 15 and pass through the inlet header 14 and project into the superheater tubes 13. In the end area of each injection water lance 16 are located openings for the fine distribution of the water to be injected. The mass flow of the injection water may be distributed evenly over the injection lances 16, for example with orifices 17.

The water injection and inlet header 14 of the superheater 8 form a unit. The actual, constructive design depends on the arrangement of the inlet header 14 (horizontal, vertical) and the branching off of the superheater tubes 13 (horizontal, vertical). In particular in the case of a vertical inlet header 14, orifices 17 can be used to ensure an even mass flow distribution over all superheater tubes.

The invention is also independent from the design of the openings at the end of the injection water lances 16.

Based on FIGS. 3 and 4, additional embodiments will now be described using the example of the heat recovery steam generator.

Figure 3:
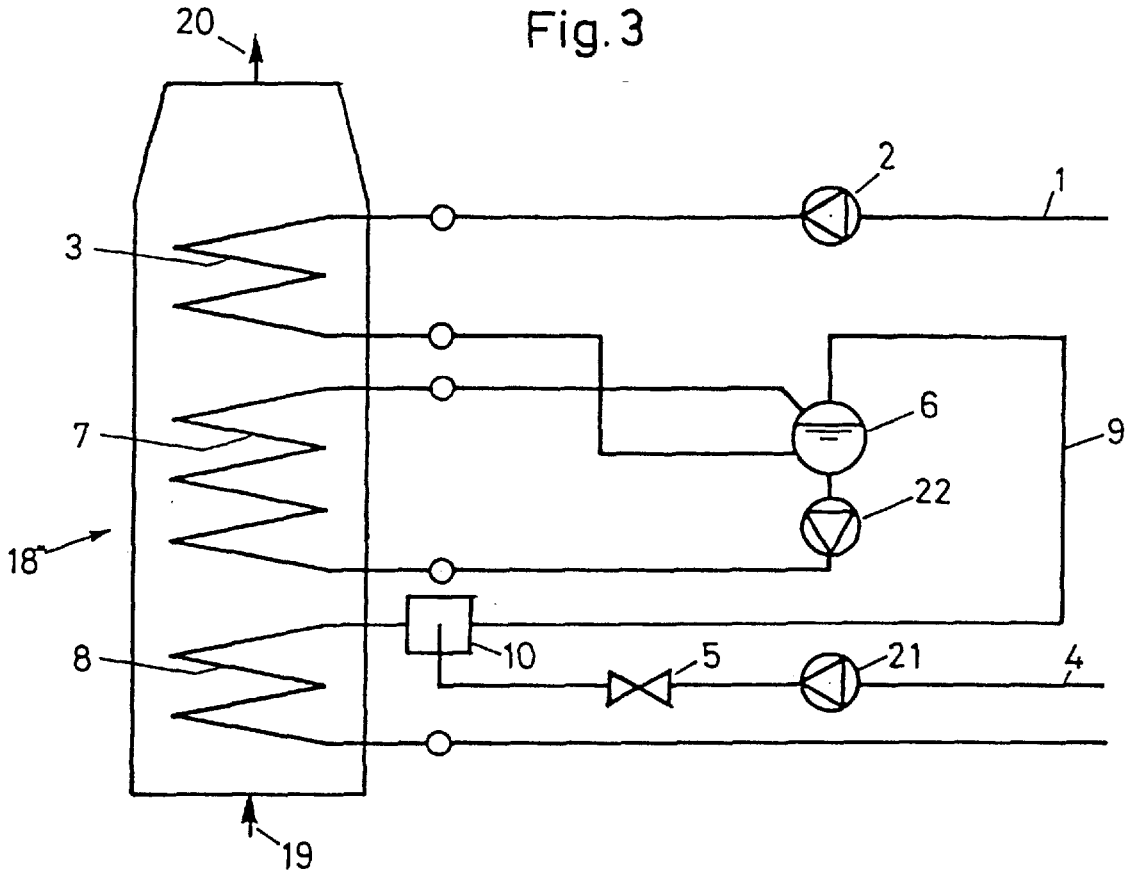
FIG. 3 shows a schematic illustration of a heat recovery steam generator constructed as a drum boiler.

FIG. 3 shows a drum boiler 18. For simplification, it is hereby assumed that only one pressure stage exists for the various heating surfaces. As a heat recovery steam generator, the drum boiler 18 is furthermore shown as following a gas turbine. It is obvious that other heating gas or flue gas sources also can be used with the boiler. Reference number 19 designates the heating gas inlet, and reference number 20 the heating gas outlet of the drum boiler 18. The feed water is transported by the feed water pump unit 2 through the feed water pipe 1 to the boiler 18. The boiler 18 has an economizer 3, an evaporator 7 with the drum 6, and a circulation pump unit 22. Furthermore, the boiler has a superheater 8.

The water injection 10 is again located at the inlet into the superheater 8. As possible ways for removing the injection water, we mention as examples the inlet and outlet at the economizer, the evaporator drum, and the inlet into the evaporator 7.

Naturally, the injection water may also come from a system outside the boiler. The important factor is only that the temperature of the injection water is lower than the saturation temperature according to the superheater pressure. The possibilities of injection water removal may be used individually or in combination.

The injection water may be moved by a pressure difference transfer pump unit 21, a difference in height, or a combination of these possibilities.

Figure 4:
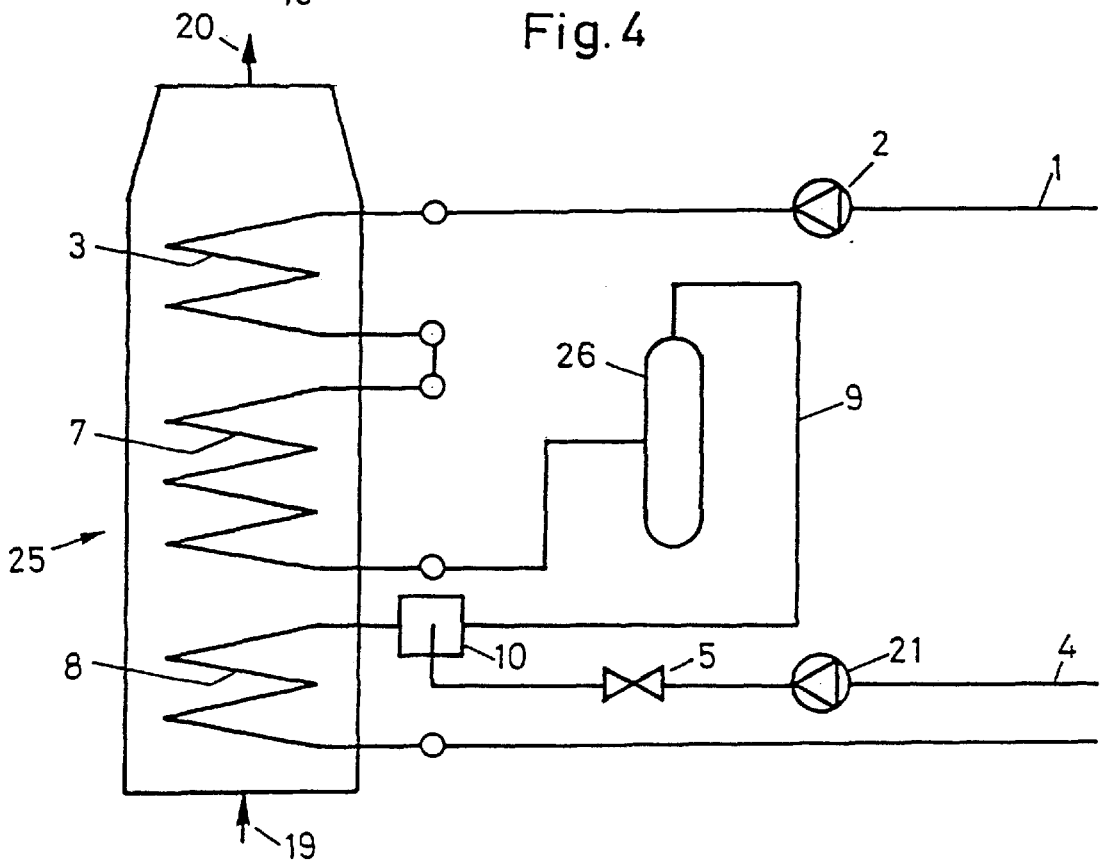
FIG. 4 shows a schematic illustration of a heat recovery steam generator constructed as a once-through boiler.

FIG. 4 shows a once-through boiler 25. The specific embodiment shown is again a heat recovery steam generator with a heating gas inlet 19 and a heating gas outlet 20.

The feed water is fed to the boiler 25 through the feed water pipe 1 with feed water pump unit 2. It is also assumed here that only one pressure stage is present in the boiler. The boiler has an economizer 3, an evaporator 7, and a superheater 8. There is also a separator 26 between the evaporator 7 and the superheater 8.

The embodiment of a once-through heat recovery steam generator also realizes the water injection 10 at the inlet into the superheater 8. The once-through principle permits other options for the injection water removal in the area of the separator (opposite from the circulation boiler).

Figure 5:
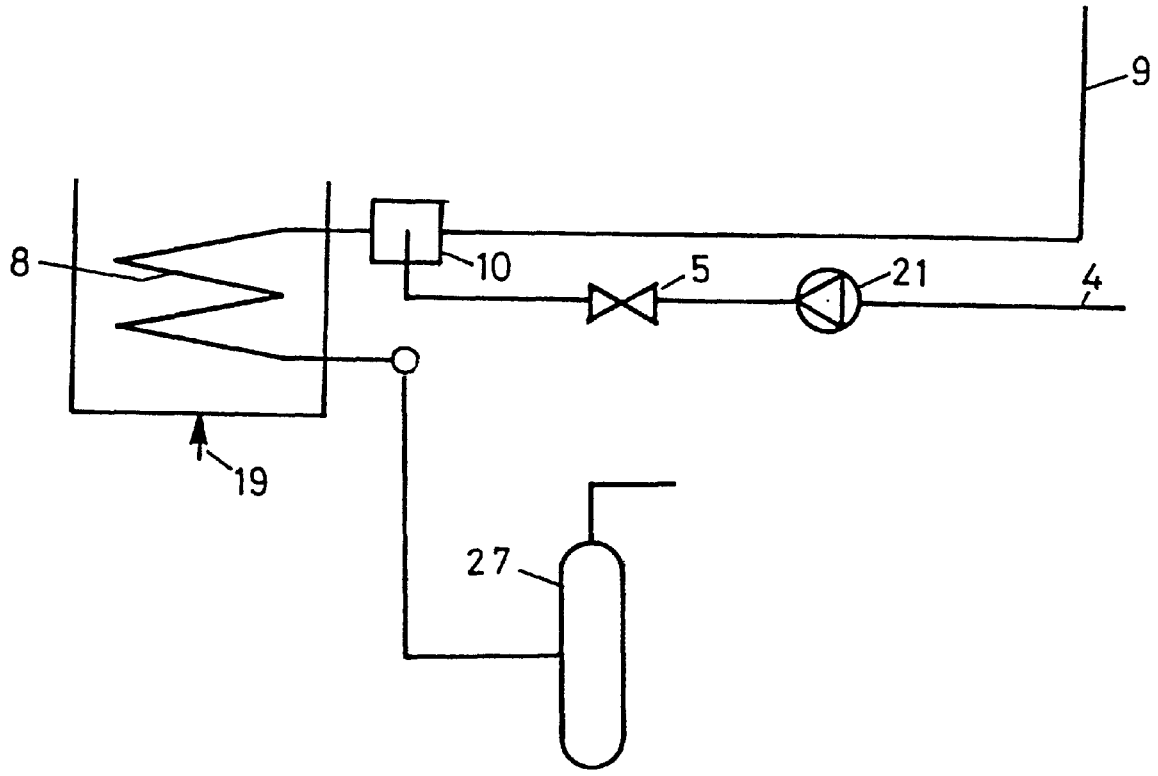
FIG. 5 shows a schematic illustration of the bottom part of the drum boiler from FIG. 3 and the bottom part of the once-through boiler of FIG. 4.

FIG. 5 shows the bottom part of the drum boiler 18 from FIG. 3 and the bottom part of the once-through boiler 25 from FIG. 4. An additional separator 27 is located at the outlet of the superheater 8. If wet steam is present at the superheater outlet, residual moisture is removed from the steam by the separator 27. The separator 27 may be used in support of or alternatively to the above mentioned control loops in order to supply saturated steam.

What is claimed is:

1. A method for controlling the temperature at the outlet of a steam superheater by water injection, comprising the step of: injecting water in the area of the inlet of the steam into the superheater, wherein the injection water is removed from a point of a boiler or a water steam cycle and that its temperature is lower and its pressure higher than the temperature or pressure at that mixing point.

2. A device useful for controlling the temperature at the outlet of a steam superheater by water injection comprising:

a steam generator including a superheater with superheater tubes and an inlet header; and a mixing point for mixing in injection water in the area of an inlet header of the superheater.

3. A device as claimed in claim 2, comprising an injection water manifold including injection water lances that project into at least one of the superheater tubes.

4. A device as claimed in claim 3, wherein the injection water lances branch off an injection water manifold located parallel to the inlet header where said injection water lances extend through the inlet header and project into the superheater tubes.

5. A device as claimed in claim 3, wherein each injection water lance projects into one superheater tube.

6. A device as claimed in claim 3, wherein the penetration depth of the injection water lances into the superheater tubes is selected dependent on the parameters at the mixing point in such a way that the injection water is entrapped by the steam and is not able to run back into the inlet header.

7. A device as claimed in claim 3, wherein the injection water lances include orifices for the controlled distribution of the individual injection water mass flows.

8. A device as claimed in claim 2, further comprising:

a control unit including a calculator part and a controller part, the calculator part being supplied with the parameters of the steam after the superheater, the calculator part capable of calculating the enthalpy of the steam from the steam parameters and supplying the calculated value of the enthalpy to the controller part in order to be compared with a desired value, the controller part being connected with a control device for controlling the quantity of the injected water.

9. A device as claimed in claim 2, further comprising a separator arranged at the outlet of the superheater to remove residual moisture from the steam.

* * * * *